US006244444B1

(12) United States Patent
Jacobus et al.

(10) Patent No.: US 6,244,444 B1
(45) Date of Patent: Jun. 12, 2001

(54) PEGGABLE RECLOSABLE BATTERY PACKAGE

(75) Inventors: Joseph H. Jacobus, Janesville, WI (US); Mark Anderson, St. Charles, IL (US); Bruce L. Kramer, Waunakee, WI (US); Sean A. Martin, Madison, WI (US); Gerald A. Albright, Middleton, WI (US)

(73) Assignee: Rayovac Corporation, Madison, WI (US)

( * ) Notice: Subject to any disclaimer, the term of this patent is extended or adjusted under 35 U.S.C. 154(b) by 0 days.

(21) Appl. No.: 09/479,473

(22) Filed: Jan. 10, 2000

(51) Int. Cl.[7] ..... B65D 85/88

(52) U.S. Cl. ..... 206/703; 206/470; 206/806; 220/839

(58) Field of Search ..... 206/703, 705, 206/461, 463, 470, 471, 806; 220/839

(56) References Cited

U.S. PATENT DOCUMENTS

| | | | | |
|---|---|---|---|---|
| 4,166,532 | | 9/1979 | Tsuchida et al. . | |
| 4,202,464 | * | 5/1980 | Moh et al. | 220/839 X |
| 4,319,684 | * | 3/1982 | Backman et al. | 206/470 X |
| 4,349,102 | | 9/1982 | Strongwater . | |
| 4,356,919 | | 11/1982 | Matney . | |
| 4,360,106 | | 11/1982 | Irvine et al. . | |
| 4,499,353 | * | 2/1985 | Shields | 206/470 |
| 4,570,818 | * | 2/1986 | Borst et al. | 220/839 X |
| 4,619,364 | | 10/1986 | Czopor, Jr. . | |
| 4,739,883 | | 4/1988 | Mohs et al. . | |
| 4,899,882 | | 2/1990 | Benner . | |
| 5,090,570 | | 2/1992 | Todd . | |
| 5,143,215 | | 9/1992 | Hartley et al. . | |
| 5,234,107 | | 8/1993 | Morel et al. . | |
| 5,429,233 | * | 7/1995 | Juristi | 206/705 |
| 5,649,621 | | 7/1997 | Brody . | |
| 5,735,404 | * | 4/1998 | Kumakura et al. | 206/705 X |

* cited by examiner

*Primary Examiner*—Bryon P. Gehman
(74) *Attorney, Agent, or Firm*—Quarles & Brady LLP

(57) ABSTRACT

A battery package has a thermoformed thermoplastic clam shell container with a lid which snaps closed on a battery containing body. The lid has peripheral skirt portions defining shoulders which face downwardly. A lower segment of a paperboard card is clasped between the lid and the body, with upper edges which engage with the shoulders of the container lid and support the container and batteries. A connecting segment extends from the lower segment and passes through a gap defined between the two shoulders to join a card upper segment having a hang hole which receives a display peg. Tape extends from the body onto the lid to close the package during display. After purchase, the tape is broken, the card is removed and discarded or recycled, and the lid is reclosable for battery storage. The lid may be hinged to the body along a side or along the bottom.

17 Claims, 3 Drawing Sheets

PEGGABLE RECLOSABLE BATTERY PACKAGE

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION

The present invention relates to specialized containers in general, and more particularly to packages for retail display of batteries.

By universal agreement, a number of battery types have been defined in terms of voltage, current, and dimensional criteria. Most common among these defined battery types are the round cells, readily available sources of direct current packaged in cylindrical canisters. These round cells have been given letter designations and range, in physical size, from AAAA, AAA, AA, C to D. Also commonly used in conventional consumer products is the non-round 9V battery.

Although the battery chemistries, available power, and recharging options may vary, the dimensions and electrical properties are confined within agreed-upon tolerances. These standardized battery properties allow consumers to replenish the battery compartments of their electronic devices from the stocks of thousands of convenience stores, hardware stores, and electronic shops throughout the world.

Advancements in microcircuitry, optics, and micromachinery have resulted in a proliferation of portable electronic devices which rely on standard battery cells for power. Whereas a hundred years ago a consumer might possess only one or two lanterns or flashlights calling for batteries, the modern household, in addition to flashlights, may have portable radios, CD and tape players, intercoms, cellular phones, computers, musical device, camcorders, interactive toys, remote control cars, calculators, or any of a multitude of home electronic devices.

To anticipate the immediate need for replacement batteries, the modern consumer is called on to maintain a stockpile of batteries of various sizes ready at hand. To address this need, manufacturers package multiple batteries in a single container, usually offering a reduced unit price for quantity purchases. Multiple batteries have been offered on blister cards, such as those shown in U.S. Pat. No. Des. 408,732; in front-to-back plastic clamshell packages, and in paperboard containers, such as those shown in U.S. Pat. No. 5,823,350.

Although a consumer may desire to purchase multiple batteries in a single package, often a single replenishment of an electrical device will not fully deplete the multi-battery package. In these cases, the unused batteries will be unconstrained unless the battery package itself serves as a container after the package has been opened. The problem presented by unconstrained batteries is particularly acute with round cells, which will tend to roll along any flat surface.

Thermoformed thermoplastic clamshell packages have been developed which support the batteries in an upright configuration when the package is displayed on a retail shelf, such as the one disclosed in U.S. Des. 413,803. Such a package has a lid which is hinged to a base, and which is reclosable after purchase and initial removal of batteries. However, many retail product displays are comprised of arrays of products supported on frontwardly projecting wires or rods, commonly referred to as "pegs." A product which is not "peggable," that is, capable of being supported on pegs, may be relegated to a less visible lower shelf, with attendant reduced visibility to customers.

What is needed is a multi-battery package which can be supported on a retail peg for attractive point of sale display while at the same time restraining a subset of the batteries within the package to serve as a container after it has been opened.

SUMMARY OF THE INVENTION

The battery package of this invention has a thermoformed thermoplastic clam shell container with a lid which snaps closed on a battery containing body. The lid has peripheral skirt portions defining shoulders which face downwardly. A paperboard card is clasped between the lid and the body and has a lower segment which extends within the container rearward of the complement of batteries and an upper segment with a hang hole which extends above the container The upper edges of the card lower segment engage with the shoulders of the container lid and support the container and batteries. A connecting segment extends between the card lower segment and the card upper segment and passes through a gap defined between the two shoulders. A strip of adhesive tape may extend from the body onto the rear surface of the lid to close the package during retail display. After purchase, the tape is cut or broken, the card is removed and discarded, and the lid is reclosable on the body to retain unconsumed batteries for later use. Because there is no adhesive connection between the card and the lid, the paper and plastic components of the package are readily separated for purposes of recycling. The lid may be hinged to the base along a side or along the bottom of the container.

It is an object of the present invention to provide a battery package which is capable of being displayed on a peg.

It is another object of the present invention to provide a battery package which displays batteries vertically, yet which stores batteries horizontally.

It is also an object of the present invention to provide a reclosable battery package which has provision for mounting on a peg within a retail environment.

It is a further object of the present invention to provide a battery package with plastic and paperboard components which are not adhesively connected and are readily separable for recycling.

It is an additional object of the present invention to provide a battery package with a hanging card which does not compromise the storage capacity of the package.

Further objects, features and advantages of the invention will be apparent from the following detailed description when taken in conjunction with the accompanying drawings.

DESCRIPTION OF THE PREFERRED EMBODIMENTS

Figure 1:
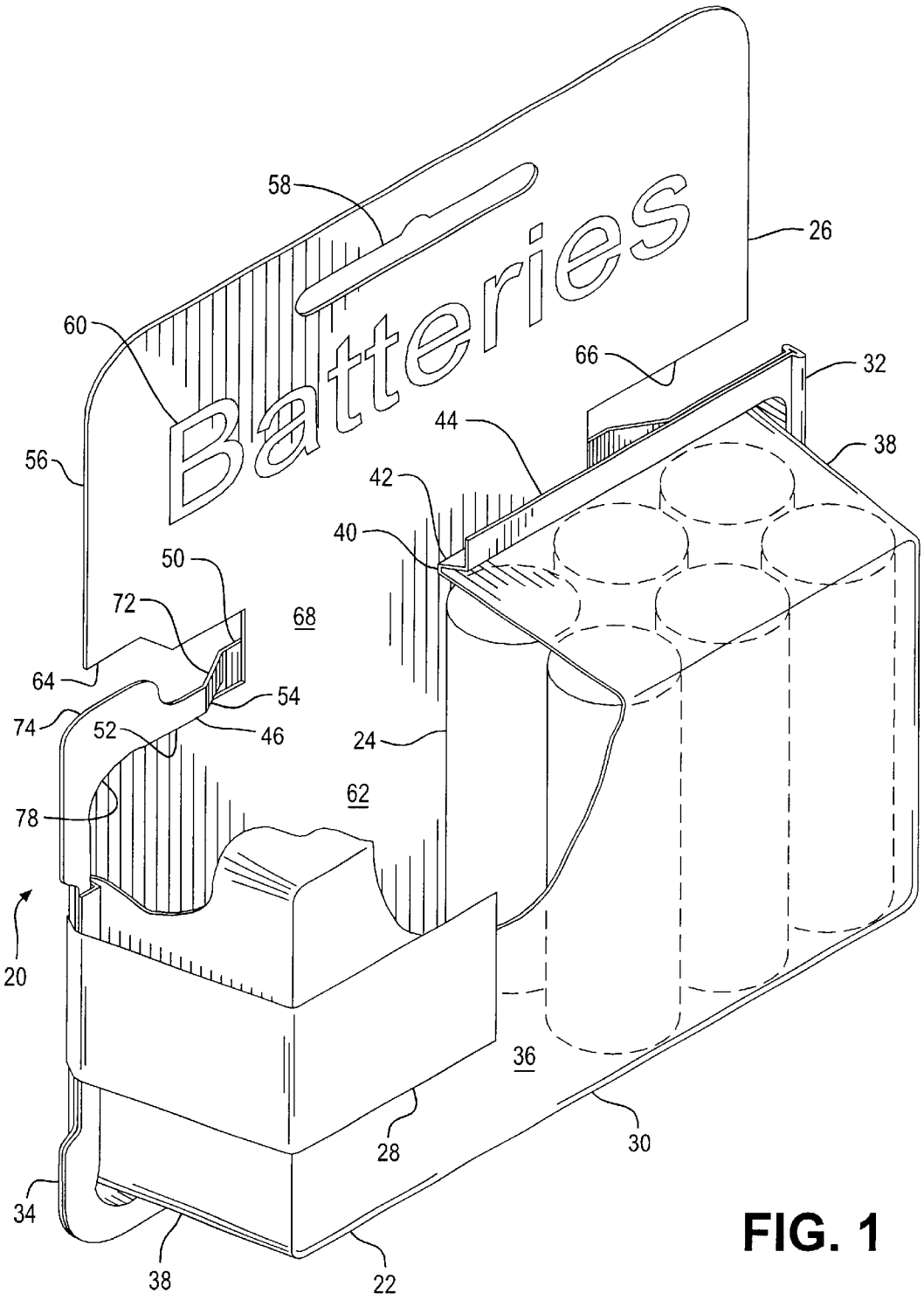
FIG. 1 is a front isometric view of the battery package of this invention, partially broken away in section.
Figure 2:
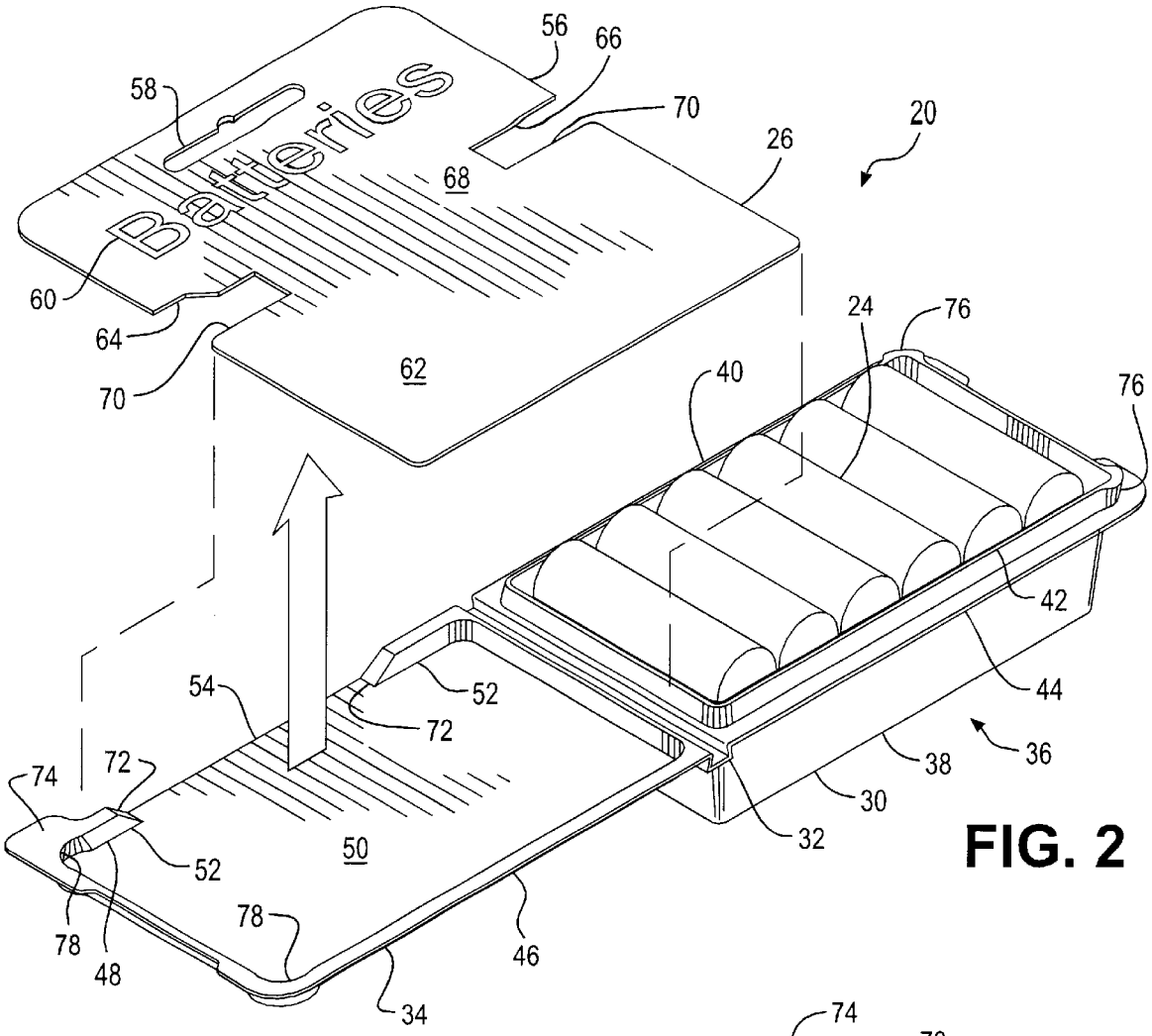
FIG. 2 is an exploded isometric view of the battery container of FIG. 1 showing the hanging card being removed.
Figure 3:
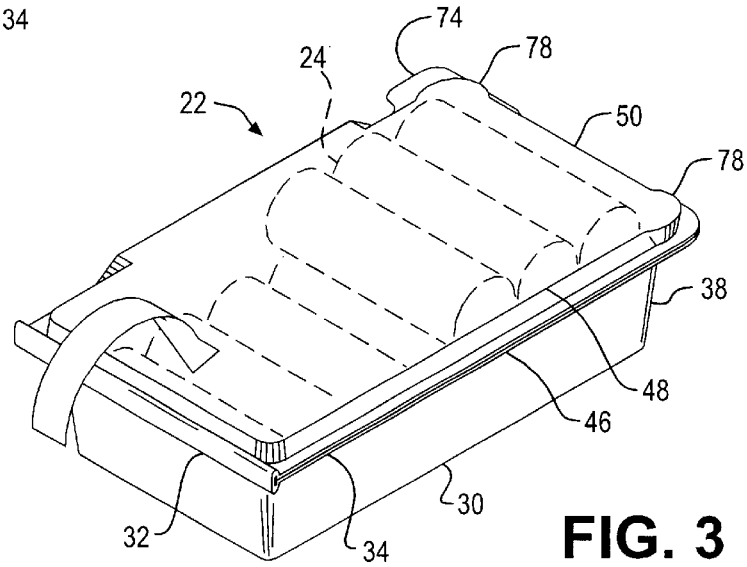
FIG. 3 is an isometric view of the container of FIG. 2 in a closed configuration.

Referring more particularly to FIGS. 1–5, wherein like numbers refer to similar parts, a battery package 20 which is configured for hanging from a frontwardly projecting wire or peg is shown in FIGS. 1–3. As shown in FIG. 1, the package 20 has a thermoformed thermoplastic battery container 22 which is filled with batteries 24 and which is closed upon a paperboard hanging card 26 and sealed with a strip of adhesive tape 28. The package 20 is capable of being supported on a peg in the retail environment, and it is also capable of serving as a reclosable container after purchase.

As shown in FIG. 2, the container 22 is formed from a thin sheet of thermoplastic material in the single sheet thermoforming process. In the single-sheet thermoforming process, a single sheet of thermoplastic material is heated and then brought into contact with a molding tool having a plurality of ports through which air is drawn to cause the semi molten plastic to conform to the shape of the molding tool. The container 22 may be formed of PVC plastic, or alternatively of polyethylene, polyurethane, polypropylene, PET, RPET, or other suitable thermoplastic materials. The sheet is a thin sheet of thermoplastic material, for example about 0.02 inches thick. The relative thicknesses of the card and the plastic of the containers has been exaggerated for clarity in the drawings.

The container 22 has a product containing bubble or body 30 which is connected by an integral hinge 32 to a reclosable lid 34. The body 30 is preferably substantially transparent to permit the enclosed batteries 24 to be viewed by a customer or purchaser. The body 30 has a display wall 36 which faces frontwardly when the package 20 is hanging from a peg, and which serves as a lower wall when the container is resting on a support surface. Four side walls 38 extend from the display wall 36 to the depth of the batteries 24 to be contained. A peripheral lip 40 extends outwardly from the side walls 38, and an encircling skirt 42 extends from the lip spaced outwardly from the side walls 38 and extending toward the display wall 36. The skirt 42 terminates at an outwardly extending flange 44 which surrounds the skirt. The hinge 32 is generally D-shaped, and extends from a peripheral flange 46 on the lid 34.

A skirt 48 projects from the lid flange 46 and joins the flange to a lid cover wall 50. When the container 22 is hanging, the uppermost portions of the skirt 48 define two downwardly facing shoulders 52 which are spaced from one another to define a gap 54 that is open upwardly and downwardly. The paperboard card 26, as shown in FIGS. 1–2, has an upper segment 56 with a die-cut hang hole 58 and which is imprinted with indicia 60 to provide point-of-sale information such as the type of product contained, price, and UPC. The card 26 has a lower segment 62 which extends downwardly from the upper segment 56, and which is received between the container lid 34 and the body 30. The card 26 has a first slot 64 and a second slot 66 which are positioned between the card upper segment 56 and lower segment 62, and which are spaced sidewardly from each other by a card connecting segment 68. The entire card 26 extends in substantially a single plane. The lower segment 62 of the card is received within the skirt 48 of the lid 34 and extends along and lies parallel to the lid cover wall 50. The lower segment 62 of the card 26 is preferably dimensioned to overlie the body peripheral lip 40 when the lid is closed on the body. As shown in FIG. 1, the card connecting segment 68 extends upwardly through the gap 54 defined between the two shoulders 52 of the lid skirt 48.

It will be noted that, when the package 20 is hanging from a peg, the upper edges 70 of the lower segment 62 of the card 26 engage with the downwardly facing lid shoulders 52, and transfer the weight of the package onto the card 26. To stiffen the shoulders 52 and the flange 46 of the lid 34, sloping gussets 72 extend between the lid cover wall 50 and the lid flange, as shown in FIG. 2.

The lid 34 is preferably provided with one outwardly extending pull tab 74 which is an extension of the lid flange 46. When the card 26 is clasped between the lid 34 and the body 30, undercut protrusions 76 on the body skirt 42, shown in FIG. 2, engage in a snap fit with undercut segments 78 formed in the skirt 48 of the lid. In the closed configuration, the lid flange 46 extends adjacent to the body flange 44, and the pull tab 74 extends beyond the body flange, permitting a consumer to readily grip the lid and pivot it about the hinge to reveal the interior of the body 30. As shown in FIG. 1, the first slot 64 in the card 26 may be enlarged to provide clearance around the pull tab 74. When closed, the peripheral lip 40 of the body 30 engages against the card 26 as the card connecting segment 68 extends upwardly between the two gussets 72 and along the lid cover wall 50 through the gap 54. The card connecting segment 68 is thus clasped between the peripheral lip 40 of the body 30, and the cover wall 50 of the lid 34. The lid skirt 48 in the closed position surrounds the body skirt 42.

To retain the package 20 in a closed configuration during shipping, storage, and retail display, and to restrict pilferage of batteries from the package in the store, a strip of adhesive tape 28 extends from the display wall 36 of the body 30 across the flanges 44, 46, to the exterior of the lid cover wall 50. The tape 28 may be transparent so as not to obstruct the view of the batteries 24 within the container 22, or the tape may be printed with consumer information or a UPC.

In retail display the package 20 is supported on a projecting peg, not shown, so that the battery filled container 22 hangs downwardly from the card 26, with the peg extending through the hang hole 58, and with the card carrying the weight of the package. In the display orientation, the cylindrical batteries 24 extend vertically within the transparent body 30. This orientation is desirable because the cylindrical surfaces of the individual batteries are typically marked with the manufacturer's name and a product identifier.

When the consumer is ready to use the first batteries from the package 20, the adhesive tape 28 is removed or cut, the pull tab 74 is engaged and the lid is separated from its snap fit attachment to the body 30. The lid 34, once released from the body, is pivoted about the hinge 32 to reveal the card 26 resting on the full complement of batteries 24 within the body 30. The card 26 is preferably not connected to the lid or the body when the container 22 is opened. Thus, as shown in FIG. 2, the paperboard card is readily separated from the plastic container 22. The convenient separation of the paperboard elements from the plastic elements greatly facilitates recycling of both portions of the packaging. In certain jurisdictions, plastic is required to be fully separated from paper before recycling, which prevents the adhesive attachment of paper to plastic in most cases. The package 20 does not have any adhesive connections between plastic elements and paper elements.

As shown in FIG. 3, once the card 26 and the first batteries are removed from the container 22, the lid 34 may be closed upon the body 30 to retain the remaining batteries, and. to securely hold them in a particular location until additional batteries are required. The package 20 thus has the advantage of being readily peggable for retail display, while at the same time being compact for storage by the user.

Figure 4:
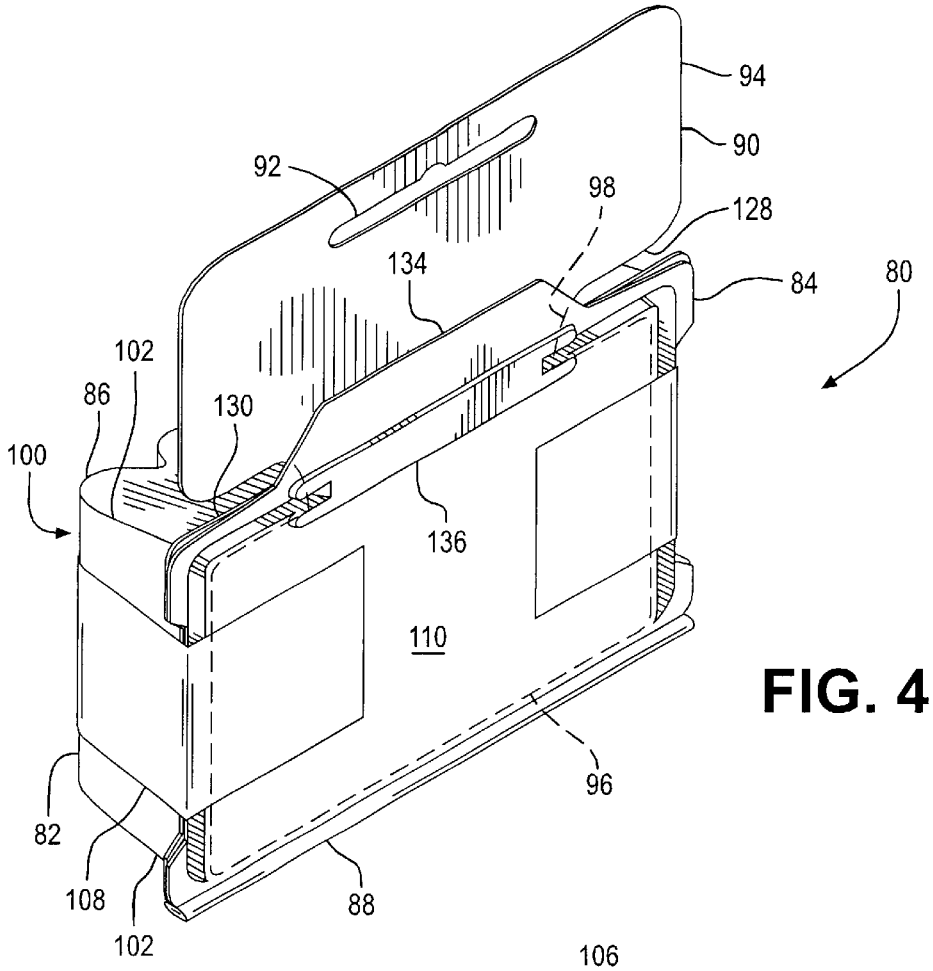
FIG. 4 is a rear isometric view of an alternative embodiment battery package of this invention having a bottom hinge.
Figure 5:
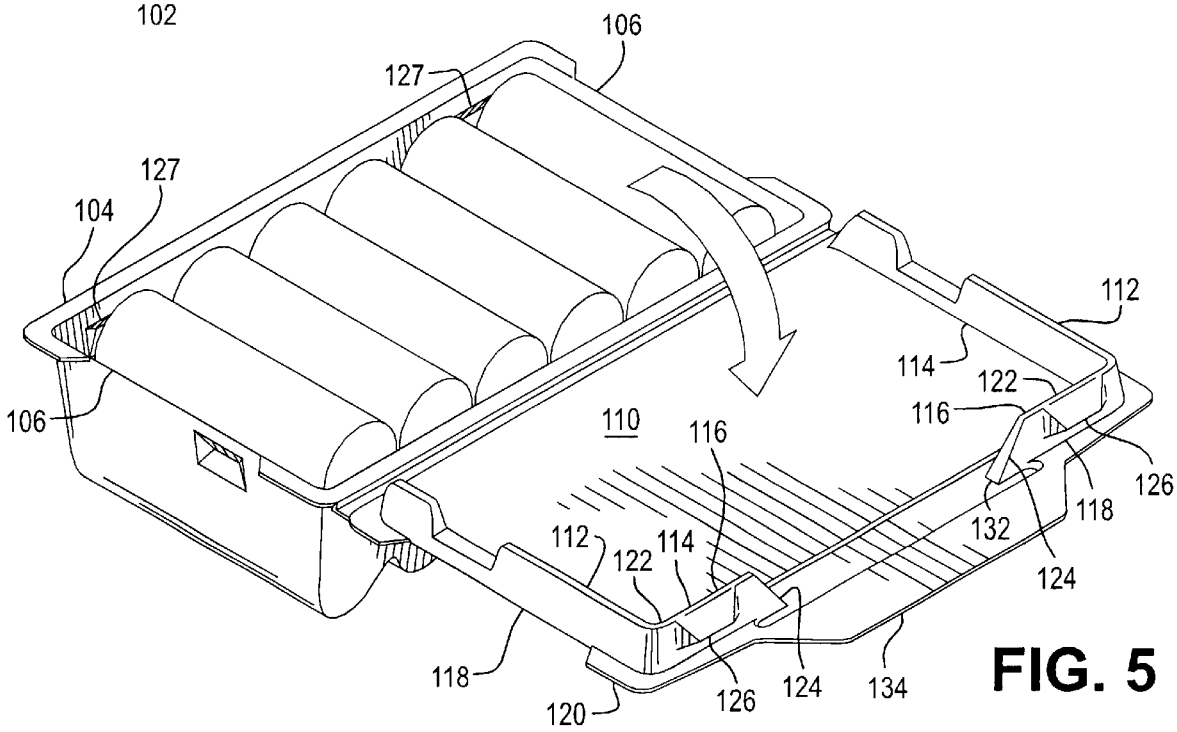
FIG. 5 is an isometric view of the battery container of FIG. 4 in an open configuration.

An alternative embodiment package 80 of this invention is shown in FIGS. 4–5. The package 80 is similar to the package 20 in that it has a single sheet thermoformed thermoplastic clam shell transparent container 82 with a lid 84 which is connected to a body 86 by an integral hinge 88. However, the hinge 88 in the package 80 extends parallel to the side of the container from which a paperboard card 90 extends. The card 90 has a hang hole 92 defined in an upper segment 94, and a lower segment 96 which is clasped between the lid and the body and connected to the upper segment by a connecting segment 98.

The body 86 has a display wall 100 with four side walls 102 which extend away from the display wall and which terminate in a peripheral flange 104. The flange 104 is trimmed very close to the side walls 102 in two locations to define notches 106 on opposite sides of the package to allow the adhesive tape 108 to extend from the body 86 onto the lid with minimal bridging across the projecting peripheral flange 104. The hinge 88 extends from the lower side wall 102 and joins the lid cover wall 110. There is no skirt adjacent the hinge 88 on the lid 84. Two protrusions 112 are formed on opposite sides of the lid 84, comprising two L-shaped structures, best shown in FIG. 5. Each protrusion 112 has an inner skirt 114 which extends away from the lid cover wall 110, a peripheral lip 116 which extends outwardly from the inner skirt 114, and an outer skirt 118 which is spaced from the inner skirt by the peripheral lip, and which extends down to a peripheral flange 120 which is continuous with and in substantially the same plane as the lid cover wall 110. Each protrusion 112 has a downwardly facing shoulder 122 defined by a portion of the inner skirt 114. Each shoulder is terminated by a gusset 124 which extends between the inner skirt 114 and the outer skirt 118, and between the peripheral lip 116 and the lid cover wall 110.

Wedge shaped projections 126 are formed on each of the protrusions 112 which face upwardly and which engage in a snap fit with corresponding recesses 117 formed in the upper side wall 102 of the body 86. As shown in FIG. 4, the card 90 has a first slot 128 and a second slot 130, such that the connecting segment 98 extends between the gap 132 defined between the two protrusions 112. The card 90 extends adjacent to the lid cover wall 110, and, as it exits the container 82, is clasped between the body flange 104 and the lid cover wall 110.

A pull tab 134 extends upwardly from the lid cover wall 110, and provides a position for gripping the lid 84 and opening the package. To stiffen the region adjacent the pull tab 134, the lid 84 may be provided with reinforcing ribs 136, as shown in FIG. 4.

The package 80 may be suspended from a retail display peg when the card is present and the package is sealed. After purchase, the card 90 is removed, as shown in FIG. 5, and the thermoformed clamshell container 82 may then be used for product storage.

It should be noted that the adhesive tape which closes the package at retail display may alternatively be wrapped from the flange of the lid around to the flange of the body at about the level of the slots 128, 130. Furthermore, as demonstrated by the two illustrated embodiments, the container may be formed such that the lid skirt engages around a body skirt, as in the package 20, or the lid may have a protruding skirt that is received within portions of the body, as in the package 80.

It should be noted that the package according to this invention may be produced with the hinge on any of the three sides other than the side through which the card extends.

Furthermore, any conventional press fit or snap fit closure mechanisms may be employed, as well as one or more pull tabs disposed at various locations.

In addition, although the package has been shown with AA batteries, it could also be formed to contain AAAA, AAA, C, D, and 9V batteries.

It is understood that the invention is not limited to the particular construction and arrangement of parts herein illustrated and described, but embraces such modified forms thereof as come within the scope of the following claims.

We claim:

1. A hanging battery package, comprising:

a thermoformed thermoplastic container having a rearwardly opening product body, and a lid connected to the body at a hinge, the lid having a rearward cover wall, the lid being engagable with the body in a snap fit, and wherein the lid has portions which project frontwardly from the cover wall to define two downwardly facing shoulders which are spaced sidewardly by a gap and wherein a flange extends outwardly from each of the two shoulders, and wherein an inclined gusset extends between the flange adjacent each shoulder and the lid cover wall on opposite sides of the gap; and a card having an upper segment, portions of which define a hang hole which is sized to receive a projection therethrough, and a lower segment which is connected to the upper segment by a connecting segment, and which extends downwardly and is received between the lid and the body; the lower segment extending along the lid cover wall, wherein two slots are defined in the card between portions of the upper segment and portions of the lower segment, the card being engaged between the lid and the body, such that the card connecting segment extends upwardly through the gap.

2. The battery package of claim 1 wherein the hinge extends generally perpendicularly to the card slots.

3. The battery package of claim 1 wherein the hinge extends generally parallel to the card slots.

4. The battery package of claim 1 further comprising a strip of adhesive tape which extends from the body onto the lid to releasably seal the container in a closed position about the card.

5. The battery package of claim 1 wherein the body has a frontwardly facing display wall, and side walls extend rearwardly from the display wall and terminate in a peripheral lip, and a peripheral skirt extends frontwardly from the lip, and wherein the frontwardly projecting portions of the lid which define the shoulders are portions of a lid skirt which extend rearwardly from a lid flange which is connected to the hinge, the lid skirt being positioned outwardly of the body skirt when the lid is closed upon the body.

6. The battery package of claim 1 wherein the body has a frontwardly facing display wall, and side walls extend rearwardly from the display wall and terminate in a peripheral flange, and wherein the frontwardly projecting portions of the lid which define the shoulders are portions of a lid inner skirt which is connected by a peripheral lip to a lid outer skirt, the lid outer skirt extending adjacent to the body side walls when the lid is closed upon the body.

7. A battery package comprising:

a card having an upper segment and a lower segment connected to the upper segment by a connecting segment, wherein at least one sidewardly opening slot is defined beneath the upper segment and above the lower segment and to the side of the connecting segment, the lower segment having an upper edge adjacent said at least one slot; and a thermoformed thermoplastic container having a body, and a lid which is hinged to the body, the lid being pivotable between a position permitting access to the interior of the container, and a closed position in which the card is clasped between the body and the lid, wherein the lid has a cover wall which extends upwardly, and wherein the card extends approximately adjacent to the cover wall, the lid having a skirt which projects frontwardly from the cover wall, the lid skirt having portions defining at least one downwardly facing shoulder which extends through said at least one slot, each shoulder engaging the card when the card upper segment is supported from a peg.

8. The battery package of claim 7 wherein the lid has an outwardly extending flange, and the body has an outwardly extending flange, and wherein the hinge extends between the lid flange and the body flange, the hinge being positioned sidewardly of the body and the lid.

9. The battery package of claim 7 wherein the hinge is positioned beneath the body and the lid.

10. The battery package of claim 7 further comprising a strip of adhesive tape which extends from the body onto the lid cover wall to releasably seal the container in a closed position about the card.

11. The battery package of claim 7 wherein the body has a frontwardly facing display wall, and side walls extend rearwardly from the display wall and terminate in a peripheral lip, and a peripheral body skirt extends frontwardly from the lip, and wherein the lid skirt is positioned outwardly of the body skirt when the lid is closed upon the body.

12. The battery package of claim 7 wherein the body has a frontwardly facing display wall, and side walls extend rearwardly from the display wall and terminate in a peripheral flange, and wherein the frontwardly projecting portions of the lid which define the lid skirt are portions of a lid inner skirt which is connected by a peripheral lip to a lid outer skirt, the lid outer skirt extending adjacent to the body side walls when the lid is closed upon the body.

13. A battery package comprising:

a thermoformed thermoplastic container having a body for containing batteries, the body having a display wall which faces frontwardly, and side walls which extend rearwardly from the display wall, the side walls terminating at a rearwardmost peripheral surface, and a lid hinged to the body and pivotable between an open position which permits access to the batteries within the body, and a closed position which is engaged with the body, the lid having a rearward cover wall, and a skirt which protrudes frontwardly from the cover wall; and a card having an upper segment which extends externally to the lid skirt, and a lower segment which is positioned within the lid skirt, and which extends substantially adjacent the cover wall, wherein the lid skirt has portions defining two downwardly facing shoulders, and further comprising an inclined gusset extending between a flange extending outwardly from each shoulder and the lid cover wall wherein portions of the card are engaged between the rearwardmost peripheral surface of the body and the cover wall.

14. The package of claim 13 wherein the card has portions defining a first slot and a second slot spaced sidewardly from the first slot, the first slot and the second slot being positioned vertically at about the same level, and wherein the package lid has two frontwardly projecting shoulders which extend through the card first slot and the card second slot.

15. The battery package of claim 13 further comprising a strip of adhesive tape which extends from the body onto the lid to releasably seal the container in a closed position about the card.

16. The battery package of claim 13 wherein the body rearwardmost peripheral surface comprises a peripheral lip, and a peripheral skirt extends frontwardly from the lip, and wherein the lid skirt is positioned outwardly of the body skirt when the lid is closed upon the body.

17. The battery package of claim 13 wherein the body side rearwardmost peripheral surface comprises a peripheral flange, and wherein the lid inner skirt comprises an inner skirt which is connected by a peripheral lip to a lid outer skirt, the lid outer skirt extending adjacent to the body side walls when the lid is closed upon the body.

* * * * *